US009287626B2

(12) United States Patent
Zou

(10) Patent No.: US 9,287,626 B2
(45) Date of Patent: Mar. 15, 2016

(54) ANTENNA AND WIRELESS TERMINAL DEVICE

(71) Applicant: Huawei Device Co., Ltd., Shenzhen (CN)

(72) Inventor: Yanyan Zou, Wuhan (CN)

(73) Assignee: Huawei Device Co., Ltd., Shenzhen (CN)

( * ) Notice: Subject to any disclaimer, the term of this patent is extended or adjusted under 35 U.S.C. 154(b) by 172 days.

(21) Appl. No.: 14/104,590

(22) Filed: Dec. 12, 2013

(65) Prior Publication Data

US 2014/0104123 A1 Apr. 17, 2014

Related U.S. Application Data

(63) Continuation of application No. PCT/CN2012/081222, filed on Sep. 11, 2012.

(30) Foreign Application Priority Data

Mar. 16, 2012 (CN) ..... 2012 1 0070698

(51) Int. Cl.
*H01Q 1/38* (2006.01)
*H01Q 9/04* (2006.01)
*H01Q 7/00* (2006.01)
(Continued)

(52) U.S. Cl.
CPC ..... *H01Q 9/0407* (2013.01); *H01Q 1/243* (2013.01); *H01Q 1/245* (2013.01); *H01Q 7/00* (2013.01); *H01Q 9/265* (2013.01)

(58) Field of Classification Search
CPC ..... H01Q 1/243; H01Q 7/00; H01Q 1/245; H01Q 9/265
USPC ..... 343/700 MS, 728, 744, 866, 702
See application file for complete search history.

(56) References Cited

U.S. PATENT DOCUMENTS 6,300,908 B1 10/2001 Jecko et al.
6,448,931 B1 9/2002 Deguchi et al.
(Continued)

FOREIGN PATENT DOCUMENTS

CN 1379618 A 11/2002
CN 1577962 A 2/2005
(Continued)

OTHER PUBLICATIONS

Im, J., et al., "Matching Techniques for Miniaturized UHF RFID Loop Antennas," IEEE Antennas and Wireless Propagation Letters, XP011330926, vol. 8, Jan. 1, 2009, pp. 266-270.
(Continued)

*Primary Examiner* — Dieu H Duong
(74) *Attorney, Agent, or Firm* — Conley Rose, P.C.; Grant Rodolph; Nicholas K. Beaulieu

(57) ABSTRACT

Embodiments of the present invention provide an antenna and a wireless terminal device. Through a first conductor connected to the inner side of an antenna body, the embodiments of the present invention can avoid the problem that in the prior art, while the antenna ensures the Specific Absorption Rate (SAR) performance of the wireless terminal device, the wireless performance of the wireless terminal device is greatly reduced. By adopting technical solutions of the present invention, while the SAR performance of the wireless terminal device is ensured, the wireless performance of the wireless terminal device cannot be affected.

20 Claims, 3 Drawing Sheets

(51) Int. Cl.
*H01Q 1/24* (2006.01)
*H01Q 9/26* (2006.01)

(56) References Cited

U.S. PATENT DOCUMENTS

| | | | | |
|---|---|---|---|---|
| 6,879,299 | B1 | 4/2005 | Uen et al. | |
| 6,958,737 | B2 | 10/2005 | Lee et al. | |
| 7,075,484 | B2 | 7/2006 | Sung | |
| 8,477,069 | B2 | 7/2013 | Hsieh et al. | |
| 2003/0112185 | A1* | 6/2003 | Fang | H01Q 1/243 343/700 MS |
| 2004/0263396 | A1 | 12/2004 | Sung | |
| 2005/0024290 | A1 | 2/2005 | Aisenbrey | |
| 2008/0291100 | A1 | 11/2008 | Chi et al. | |
| 2011/0043421 | A1 | 2/2011 | Hsieh et al. | |
| 2012/0112971 | A1 | 5/2012 | Takeyama et al. | |

FOREIGN PATENT DOCUMENTS

| | | | |
|---|---|---|---|
| CN | 101997164 | A | 3/2011 |
| CN | 102280700 | A | 12/2011 |
| DE | 10347719 | A1 | 1/2005 |
| EP | 2175519 | A1 | 4/2010 |
| JP | 08051312 | A | 2/1996 |
| JP | 3511402 | B2 | 3/2004 |
| JP | 2010093597 | A | 4/2010 |
| JP | 2004320571 | A | 11/2011 |
| WO | 2005022684 | A2 | 3/2005 |
| WO | 2006049382 | A1 | 5/2006 |
| WO | 2010150452 | A1 | 12/2010 |

OTHER PUBLICATIONS

Foreign Communication From a Counterpart Application, European Application No. 12871289.0, Extended European Search Report dated Jul. 23, 2014, 8 pages.

Foreign Communication From a Counterpart Application, Chinese Application No. 201210070698.5, Chinese Office Action dated Sep. 23, 2014, 8 pages.

Foreign Communication From a Counterpart Application, Chinese Application No. 201210070698.5, Chinese Office Action dated Jun. 4, 2015, 8 pages.

Partial English Translation and Abstract of Japanese Patent Application No. JP2004320571A, Part 1, Jun. 12, 2015, 3 pages.

Partial English Translation and Abstract of Japanese Patent Application No. JP2004320571A, Part 2, Jun. 12, 2015, 8 pages.

Foreign Communication From a Counterpart Application, Japanese Application No. 2014-516183, Japanese Rejection dated May 12, 2015, 2 pages.

Foreign Communication From a Counterpart Application, Japanese Application No. 2014-516183, English Translation of Japanese Rejection dated May 12, 2015, 3 pages.

Partial English Translation and Abstract of Chinese Patent Application No. CN001379618A, Jan. 3, 2014, 3 pages.

Partial English Translation and Abstract of Chinese Patent Application No. CN102280700A, Jan. 3, 2014, 4 pages.

Foreign Communication From a Counterpart Application, PCT Application No. PCT/CN2012/081222, English Translation of Chinese Search Report dated Dec. 20, 2012, 3 pages.

Foreign Communication From a Counterpart Application, PCT Application No. PCT/CN2012/081222, Chinese Written Opinion dated Dec. 20, 2012, 6 pages.

Partial English Translation and Abstract of Japanese Patent Application No. JP2010-093597A, Jan. 23, 2015, 13 pages.

Foreign Communication From a Counterpart Application, Japanese Application No. 2014-516183, Japanese Office Action dated Dec. 9, 2014, 3 pages.

Foreign Communication From a Counterpart Application, Japanese Application No. 2014-516183, English Translation of Japanese Office Action dated Dec. 9, 2014, 3 pages.

* cited by examiner

ANTENNA AND WIRELESS TERMINAL DEVICE

CROSS-REFERENCE TO RELATED APPLICATIONS

This application is a continuation of International Application No. PCT/CN2012/081222, filed on Sep. 11, 2012, which claims priority to Chinese Patent Application No. 201210070698.5, filed on Mar. 16, 2012, both of which are hereby incorporated by reference in their entireties.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

Embodiments of the present invention relate to communications technologies, and in particular, to an antenna and a wireless terminal device.

BACKGROUND

With the development of wireless communication technologies, more and more wireless terminal devices appear, such as a tablet and a data card. While a user enjoys various conveniences brought by a wireless terminal device, the user also pays more and more attention to influence on human health caused by electromagnetic radiation generated by the wireless terminal device. As an indicator for measuring the electromagnetic radiation intensity of the wireless terminal device when the wireless terminal device is close to a human body, a specific absorption rate (SAR) has become one piece of content which is marked on product packages or specifications by wireless terminal device manufacturers from many countries and regions. In the prior art, a proximity sensor may be added near an antenna, so that when a wireless terminal device gets close to a human body, transmission power is reduced actively, so as to ensure the SAR performance of the wireless terminal device.

However, while the antenna ensures the SAR performance of the wireless terminal device, the transmission power is reduced, so the wireless performance of the wireless terminal device is greatly reduced.

SUMMARY

Embodiments of the present invention provide an antenna and a wireless terminal device, so that while the SAR performance of a wireless terminal device is ensured, the wireless performance of the wireless terminal device is not affected.

In one aspect, an antenna is provided, which includes a ring-shaped antenna body, where the inner side of the antenna body is connected to a first conductor through a conductor connecting part, so that current on the antenna body is dispersed to the first conductor, and the first conductor is encircled by the antenna body.

According to the above antenna, the antenna further includes a gap, which passes through the conductor connecting part, the antenna body connected to the conductor connecting part and the first conductor connected to the conductor connecting part.

According to the above antenna, the shape of the gap includes a linear type, an L shape, or a T shape.

According to the above antenna, the antenna body and the first conductor are disposed in a folding way along a specified direction.

According to the above antenna, the upper side of the antenna body is disposed with a second conductor, and a plane where the second conductor is located is parallel to a plane where the antenna body is located.

In another aspect, a wireless terminal device is provided, which includes a printed circuit board (PCB) and the above antenna, where the PCB is connected to the antenna body.

It may be known from the above technical solutions that, in the embodiments of the present invention, through the first conductor connected to the inner side of the antenna body, the current on the antenna body is enabled to be dispersed to the first conductor, which can avoid the problem that in the prior art, while the antenna ensures the SAR performance of the wireless terminal device, the wireless performance of the wireless terminal device is greatly reduced. By adopting the technical solutions of the present invention, while the SAR performance of the wireless terminal device is ensured, the wireless performance of the wireless terminal device cannot be affected.

BRIEF DESCRIPTION OF THE DRAWINGS

To describe the technical solutions in the embodiments of the present invention or in the prior art more clearly, the following briefly introduces the accompanying drawings needed for describing the embodiments. The accompanying drawings in the following description show some embodiments of the present invention, and persons of ordinary skill in the art may still derive other drawings from these accompanying drawings without creative efforts.

DETAILED DESCRIPTION

To make the objectives, technical solutions, and advantages of the embodiments of the present invention more comprehensible, the following clearly describes the technical solutions in the embodiments of the present invention with reference to the accompanying drawings in the embodiments of the present invention. The described embodiments are merely a part rather than all of the embodiments of the present invention. All other embodiments obtained by persons of ordinary skill in the art based on the embodiments of the present invention without creative efforts shall fall within the protection scope of the present invention.

The wireless terminal device in embodiments of the present invention may include but is not limited to a tablet or a data card.

An embodiment of the present invention provides an antenna, which may include a ring-shaped antenna body, where the inner side of the antenna body is connected to a first conductor through a conductor connecting part, and the first conductor is encircled by the antenna body. Through the first conductor connected to the inner side of the antenna body, the problem can be avoided that in the prior art, while the antenna ensures the SAR performance of the wireless terminal device, the wireless performance of the wireless terminal device is greatly reduced. By adopting the technical solutions of the present invention, while the SAR performance of the wireless terminal device is ensured, the wireless performance of the wireless terminal device cannot be affected.

Optionally, the antenna may further include a gap, which passes through the conductor connecting part, the antenna body connected to the conductor connecting part and the first conductor connected to the conductor connecting part.

Optionally, the shape of the gap may include but is not limited to a linear type, an L shape, or a T shape.

Optionally, the antenna body and the first conductor may be disposed in a folding way along a specified direction.

Optionally, the upper side of the antenna body may be further disposed with a second conductor.

Figure 1:
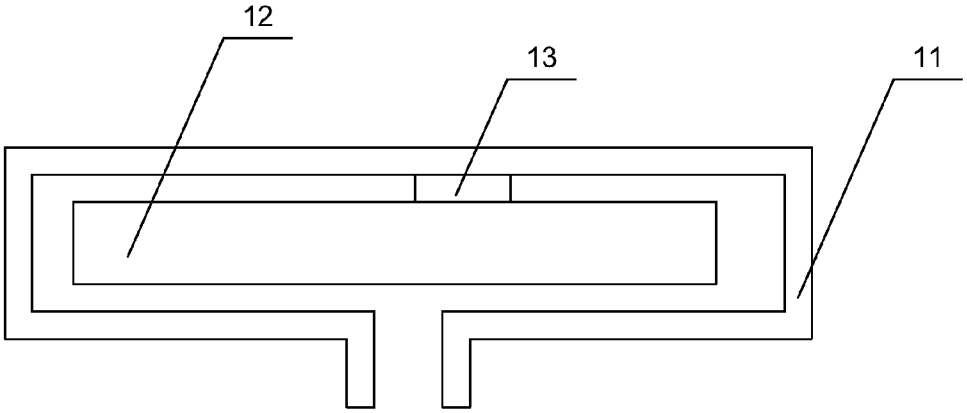
FIG. 1 is a schematic structural diagram of an antenna according to an embodiment of the present invention.

FIG. 1 is a schematic structural diagram of an antenna provided by an embodiment of the present invention. As shown in FIG. 1, the antenna of this embodiment includes a ring-shaped antenna body 11, the inner side of the antenna body 11 is connected to a first conductor 12 through a conductor connecting part 13, and the first conductor 12 is encircled by the antenna body 11.

In an optional implementation manner of this embodiment, the conductor connecting part 13 and the first conductor 12 may include but are not limited to metal conductors such as copper or iron, or may further include nonmetal conductors such as carbon.

The first conductor 12 can change the surface current distribution (namely, peak distribution) situation on the antenna body 11 through the conductor connecting part 13, and the distribution situation of the surface current on the antenna body 11 changes after the surface current passes through the first conductor 12, namely, the current on the antenna body 11 can be dispersed to the first conductor 12 through the conductor connecting part 13, so as to reduce the strength of the current on the antenna body 11, and especially reduce the strength of the current near the conductor connecting part 13 obviously. The SAR performance of the wireless terminal device is related to the distribution situation of the surface current on the antenna, for example, if the strength of the surface current is reduced, the SAR is reduced. Through the first conductor 12 which is connected to the inner side of the antenna body 11 through the conductor connecting part 13, the SAR performance of the wireless terminal device may be improved. The area of the first conductor 12 may be 50% to 90% of the area encircled by the antenna body 11.

In this embodiment, through the first conductor connected to the inner side of the antenna body, the current on the antenna body is enabled to be dispersed to the first conductor, which can avoid the problem that in the prior art, while the antenna ensures the SAR performance of the wireless terminal device, the wireless performance of the wireless terminal device is greatly reduced. By adopting the technical solutions of the present invention, while the SAR performance of the wireless terminal device is ensured, the wireless performance of the wireless terminal device cannot be affected.

Figure 2:
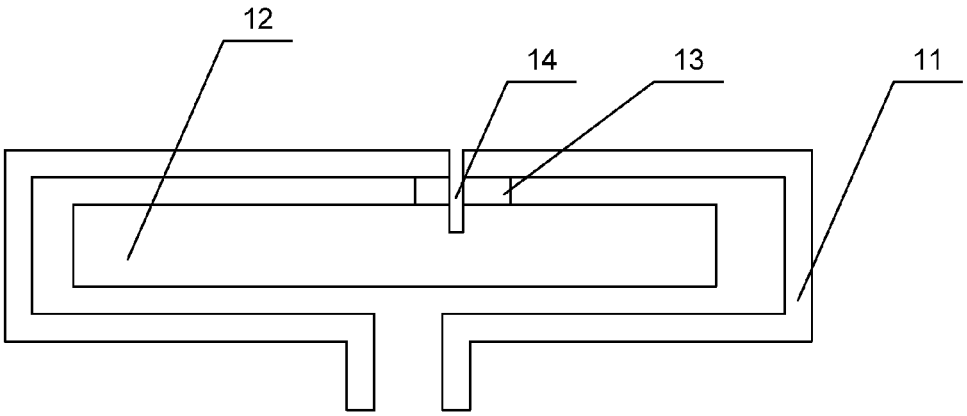
FIG. 2 is a schematic structural diagram of an antenna according to another embodiment of the present invention.
Figure 3:
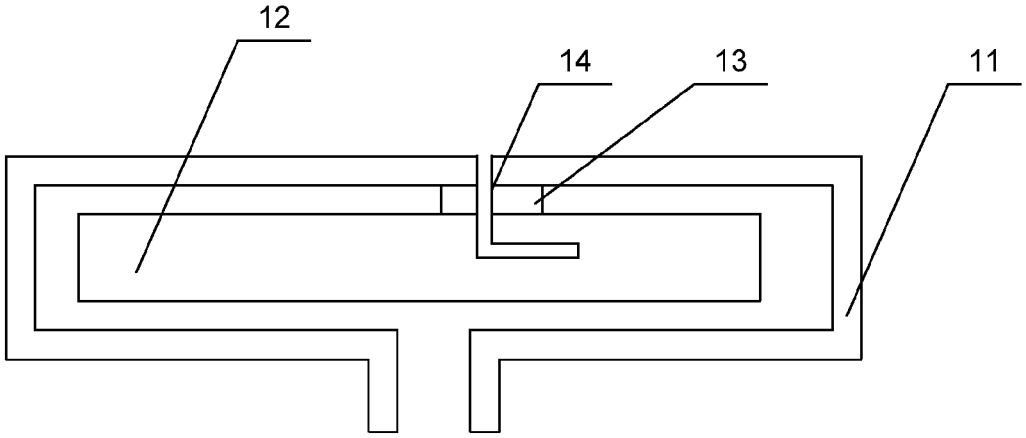
FIG. 3 is a schematic structural diagram of an antenna according to another embodiment of the present invention.
Figure 4:
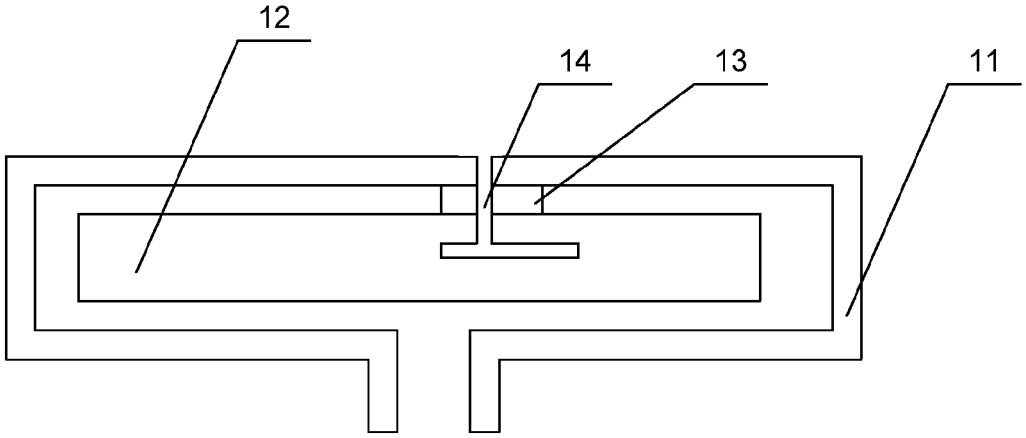
FIG. 4 is a schematic structural diagram of an antenna according to another embodiment of the present invention.

FIG. 2 to FIG. 4 are schematic structural diagrams of an antenna provided by another embodiment of the present invention. As shown in FIG. 2 to FIG. 4, compared with the antenna provided by the embodiment corresponding to FIG. 1, the antenna provide by this embodiment may further include a gap 14, which passes through the conductor connecting part 13, the antenna body 11 connected to the conductor connecting part 13 and the first conductor 12 connected to the conductor connecting part.

Optionally, the shape of the gap may include but is not limited to a linear type (shown in FIG. 2), an L shape (shown in FIG. 3), or a T shape (shown in FIG. 4).

In this embodiment, through the gap opened on the antenna, the adjustment of an input impedance matching characteristic (namely, a matching degree of the input impedance and a system circuit of the antenna) of the antenna may be implemented by adjusting parameters such as length and width of the gap, thereby further improving the wireless performance of the antenna, for example: wireless sensitivity of the antenna. In an optional implementation manner of this embodiment, the antenna provided by the present invention may have a plurality of resonance frequency points, so the resonance frequency points of the antenna may be lowered by lengthening the gap, thereby improving the wireless sensitivity of the antenna.

It should be noted that the antenna body 11 involved in this embodiment may also be the shape of other irregular rings, which is not limited in the embodiment of the present invention. The first conductor 12 involved in this embodiment is not necessarily the shape of a rectangle, and may also be other shapes, for example: regular shapes such as a trapezoid or a parallelogram, or may also be irregular shapes, which is not limited in the embodiment of the present invention.

Figure 5:
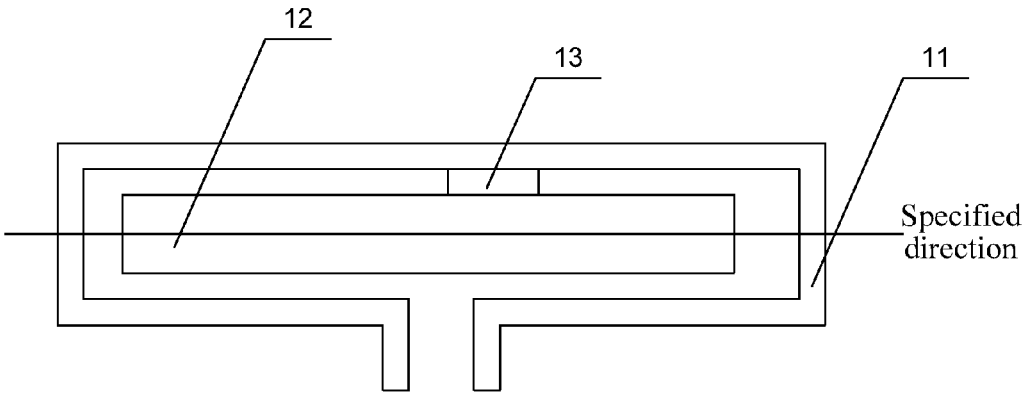
FIG. 5 is a schematic structural diagram of an antenna according to another embodiment of the present invention.

In an optional implementation manner of this embodiment, the antenna body 11 and the first conductor 12 may further be disposed in a folding way along a specified direction (for example: a narrow side direction of the antenna), which can further reduce the volume of the antenna, as shown in FIG. 5. The specified direction may be preset by manufacturers of the antenna, manufacturers of the wireless terminal where the antenna is located or users of the antenna according to the environment to which the antenna is applied (namely, the specification of the wireless terminal device where the antenna is located), and may be any directions.

Figure 6:
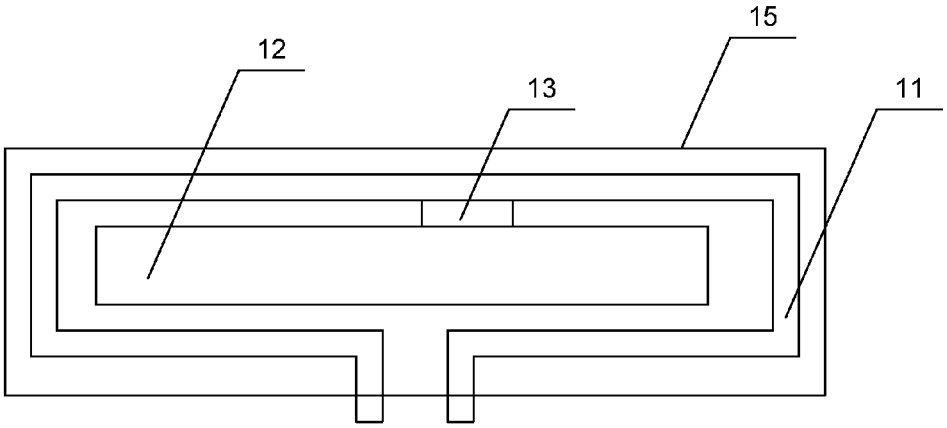
FIG. 6 is a schematic structural diagram of an antenna according to another embodiment of the present invention.

FIG. 6 is a schematic structural diagram of an antenna provided by another embodiment of the present invention. As shown in FIG. 6, compared with the antenna provided by the embodiment corresponding to FIG. 1, in the antenna provided by this embodiment, a second conductor 15 may be further disposed on a plane parallel to a plane where the antenna body 11 is located, so as to block a part of radiation of electromagnetic wave, and further improve the SAR performance of the wireless terminal device. The distance between the plane where the antenna body 11 is located and the plane where the second conductor 15 is located may range from 2 millimeters to one tenth of the wavelength of the electromagnetic wave corresponding to a resonance frequency of the antenna body. It should be understood that the second conductor 15 may be fixed on many places, for example: may be fixed on a housing of the wireless terminal device where the antenna is located, or may also be fixed on a PCB connected to the antenna, which is not limited in this embodiment.

In an optional implementation manner of this embodiment, the second conductor 15 may include but is not limited to metal conductors such as copper or iron, or may further include nonmetal conductors such as carbon.

Another embodiment of the present invention further provides a wireless terminal device, which may include a PCB and the antenna provided by the above embodiments corresponding to FIG. 1 to FIG. 6, where the PCB is connected to the antenna body.

In the foregoing embodiments, the description of each of the embodiments has respective focuses. For a part that is not described in detail in a certain embodiment, reference may be made to related descriptions in other embodiments.

Finally, it should be noted that the foregoing embodiments are merely intended for describing the technical solutions of the present invention other than limiting the present invention. Although the present invention is described in detail with reference to the foregoing embodiments, persons of ordinary skill in the art should understand that they may still make modifications to the technical solution described in the foregoing embodiments or make equivalent replacements to some technical features thereof without departing from the spirit and scope of the technical solution of the embodiments of the present invention.

What is claimed is:

1. An antenna, comprising:

a ring-shaped antenna body;

a first conductor that is encircled by the antenna body;

a conductor connecting part; and a gap located in the antenna body, the first conductor, and the conductor connecting part, wherein an inner side of the antenna body is connected to the first conductor through the conductor connecting part such that current on the antenna body is dispersed to the first conductor, wherein the gap passes through the antenna body, the conductor connecting part, and the first conductor, and wherein the gap enters the first conductor through the conductor connecting part.

2. The antenna according to claim 1, wherein an area of the first conductor is 50% to 90% of an area encircled by the antenna body.

3. The antenna according to claim 1, wherein the first conductor comprises a rectangular shape, and wherein the first conductor and the conductor connecting part comprise carbon.

4. The antenna according to claim L wherein a shape of the gap comprises a linear type, an L shape, or a T shape.

5. The antenna according to claim 1, wherein the antenna body and the first conductor are disposed in a folding way along a specified direction.

6. The antenna according to claim 1, wherein a second conductor is disposed on a plane parallel to a plane where the antenna body is located.

7. The antenna according to claim 6, wherein the second conductor comprises a solid rectangular shape, and wherein an outer periphery of the second conductor is larger than an outer periphery of the first conductor.

8. A wireless terminal device, comprising:

a printed circuit board (PCB); and an antenna, wherein the antenna comprises a ring-shaped antenna body connected to the PCB, wherein an inner side of the antenna body is connected to a first conductor through a conductor connecting part such that current on the antenna body is dispersed to the first conductor, wherein the first conductor is encircled by the antenna body, wherein the antenna further comprises a gap, wherein the gap passes through the antenna body, the conductor connecting part, and the first conductor, and wherein the gap enters the first conductor through the conductor connecting part.

9. The wireless terminal device according to claim 8, wherein an area of the first conductor is 50% to 90% of an area encircled by the antenna body.

10. The wireless terminal device according to claim 8, wherein the first conductor comprises a rectangular shape, and wherein the first conductor and the conductor connecting part comprise carbon.

11. The wireless terminal device according to claim 10, wherein a shape of the gap comprises a linear type, an L shape, or a T shape.

12. The wireless terminal device according to claim 8, wherein the antenna body and the first conductor are disposed in a folding way along a specified direction.

13. The wireless terminal device according to claim 8, wherein a second conductor is disposed on a plane parallel to a plane where the antenna body is located.

14. The wireless terminal device according to claim 13, wherein the second conductor comprises a solid rectangular shape, and wherein an outer periphery of the second conductor is larger than an outer periphery of the first conductor.

15. The wireless terminal device according to claim 8, wherein a shape of the first conductor comprises a rectangle.

16. The wireless terminal device according to claim 8, wherein a shape of the first conductor comprises a trapezoid.

17. The wireless terminal device according to claim 8, wherein a shape of the first conductor comprises a parallelogram.

18. The wireless terminal device according to claim 8, wherein a shape of the first conductor comprises an irregular shape.

19. An apparatus, comprising:

a printed circuit board (PCB);

an antenna having a ring-shaped antenna body that is connected to the PCB; and a first conductor that is encircled by the antenna body, wherein an inner side of the antenna body is connected to the first conductor through a conductor connecting part such that current on the antenna body is dispersed to the first conductor, wherein the antenna further comprises a gap, wherein the gap passes through the antenna body, the conductor connecting part, and the first conductor, and wherein the gap enters the first conductor through the conductor connecting part.

20. The apparatus according to claim 19, wherein the first conductor and the conductor connecting part comprise copper, iron, and/or carbon.

* * * * *

UNITED STATES PATENT AND TRADEMARK OFFICE

CERTIFICATE OF CORRECTION

PATENT NO. : 9,287,626 B2
APPLICATION NO. : 14/104590
DATED : March 15, 2016
INVENTOR(S) : Yanyan Zou It is certified that error appears in the above-identified patent and that said Letters Patent is hereby corrected as shown below:

In the claims,

Column 5, Claim 4, Lines 43-44 should read:

The antenna according to claim 1, wherein a shape of the gap comprises a linear type, an L shape, or a T shape.

Signed and Sealed this
Twenty-sixth Day of July, 2016

Michelle K. Lee

Michelle K. Lee
*Director of the United States Patent and Trademark Office*